US011376192B2

(12) United States Patent
Spallek et al.

(10) Patent No.: US 11,376,192 B2
(45) Date of Patent: Jul. 5, 2022

(54) PLASTIC CONTAINER PRODUCT

(71) Applicant: KOCHER-PLASTIK MASCHINENBAU GMBH, Sulzbach-Laufen (DE)

(72) Inventors: Michael Spallek, Ingelheim (DE); Johannes Geser, Gerlingen (DE); Alexander Hammer, Gaildorf (DE); Alexander Beier, Oberrot (DE); Michael Schultes, Fichtenau (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 406 days.

(21) Appl. No.: 16/468,328

(22) PCT Filed: Feb. 23, 2018

(86) PCT No.: PCT/EP2018/054551
§ 371 (c)(1),
(2) Date: Jun. 11, 2019

(87) PCT Pub. No.: WO2018/162255
PCT Pub. Date: Sep. 13, 2018

(65) Prior Publication Data

US 2020/0085688 A1 Mar. 19, 2020

(30) Foreign Application Priority Data

Mar. 7, 2017 (DE) ..... 10 2017 002 401.4

(51) Int. Cl.
*A61J 1/14* (2006.01)
*B65D 1/02* (2006.01)
(Continued)

(52) U.S. Cl.
CPC ..... *A61J 1/1406* (2013.01); *A61J 1/1412* (2013.01); *A61J 1/1475* (2013.01); *B65D 1/0215* (2013.01); *B65D 47/103* (2013.01); *B65D 51/002* (2013.01)

(58) Field of Classification Search
CPC ..... A61J 1/1406; A61J 1/1475; B65D 1/0238; B65D 17/00; B65D 41/20; B65D 41/50; B65D 51/002
See application file for complete search history.

(56) References Cited

U.S. PATENT DOCUMENTS 4,254,884 A 3/1981 Maruyama
4,419,323 A * 12/1983 Winchell ..... A61J 1/1406 215/380
(Continued)

FOREIGN PATENT DOCUMENTS

CN 85103261 10/1986
DE 103 17 712 11/2004
(Continued)

OTHER PUBLICATIONS

International Search Report (ISR) dated Jun. 29, 2018 in International (PCT) Application No. PCT/EP2018/054551.

*Primary Examiner* — Mollie Impink
(74) *Attorney, Agent, or Firm* — Wenderoth, Lind & Ponack, L.L.P.

(57) ABSTRACT

A plastic container product, particularly produced according to a blow-moulding, filling and sealing method, includes a container body having a container content and a head part (12) connected to the container body. The head part defines a removal region (14) closed by a head membrane (16) with joint seam (38) that passes through a surface (20) spanned by the head membrane (16) and that separates at least two penetrable regions (22, 24) on the free front side (26) of the head membrane (16), for the removal of the content. The
(Continued)

joint seam (38), observed from the free front side (26) of the head membrane (16), has a seam line (36) that at least partially deviates from an imaginary straight line (32), extends inside the surface (20), is longer than the straight line (32) and at least partially encompasses the penetrable regions (22, 24).

41 Claims, 5 Drawing Sheets

(51) Int. Cl.
*B65D 47/10* (2006.01)
*B65D 51/00* (2006.01)

(56) References Cited

U.S. PATENT DOCUMENTS 4,574,965 A 3/1986 Meierhoefer
5,395,365 A * 3/1995 Weiler ..... A61J 1/1406 128/DIG. 24
5,868,721 A 2/1999 Marinacci et al.
2010/0065526 A1* 3/2010 Consolaro ..... B65D 1/0238 215/247
2010/0326990 A1 12/2010 Mader
2015/0157535 A1 6/2015 Frishman

FOREIGN PATENT DOCUMENTS

DE 103 47 908 5/2005
DE 10 2008 009 418 4/2009
DE 10 2013 012 809 2/2015
EP 0 183 723 4/1990
EP 0 621 027 10/1994
EP 1 616 549 1/2006
EP 2 269 558 1/2011
WO 81/02286 8/1981
WO 85/05611 12/1985
WO 86/06043 10/1986
WO WO-2016015742 A1 * 2/2016 ..... B65D 51/002

* cited by examiner

PLASTIC CONTAINER PRODUCT

FIELD OF THE INVENTION

The invention relates to a plastic container product, in particular one produced by a blow molding, filling and sealing method, including a container body having a content of the container and an adjoining head part, which delimits an extraction area. The extraction area is closed by a head membrane, which has a connecting seam. The connecting seam passes through a surface spanned by the head membrane and separates penetrable areas on the free end face of the head membrane from each other for extracting the content of the container.

BACKGROUND OF THE INVENTION

Plastic containers, which are produced in a blow-molding, filling and sealing process (BFS process), as described, for example, in EP 2 269 558 A1 and also known in the professional world as the Bottelpack® system, are used with great advantage for food and luxury foodstuff and in medicine for the packaging of pharmaceuticals, diagnostics, enteral nutrition and medical devices, e.g. rinsing and dialysis solutions. A significant advantage of these containers for such purposes is that the contents are solely in contact with a polymer constituting the container material, typically a plastic such as LDPE, HDPE or PP. The germ reduction/sterility of the contents can be maintained for extended periods of time using integral containers made and filled using the BFS process. Containers intended for injection, infusion, transfusion or enteral nutrition have a specific shape of the head area for the formation of points of access to the contents of the container. The integral design of container and head makes for a secure sterility of the contents at a particularly efficient implementation of the manufacturing process. Caps having elastomer sealing elements (DIN ISO 15759) are applied to the container head by welding or injection molding. In such containers—just like in other container products for medical purposes, such as injection vials, cylindrical vials or plastic containers for injections (DIN EN ISO 15747:2012-07)—polymer or elastomer particles can be punched out of the closure material, e.g. when puncturing using injection needles or piercing devices. These loose particles can remain in the cannula, the syringe, or in the container itself. This situation can inter alia lead to the clogging of the cannula, rendering the extraction and/or the injection procedure impossible. Particles can also get into the product.

In view of this problem, EN ISO 8871-5:2014 specifies limits in the use of injection vials having an elastomeric closure, same as in the US Pharmacopoeia Chapter 381. To address this problem—also known as fragmentation—special needle geometries have been proposed by Marinacci et al. in the prior art (U.S. Pat. No. 5,868,721), which, however, necessitate costly and expensive special cannulas.

WO 81/02286 discloses a plastic container having preferred thin-walled piercing positions for a cannula arranged on a defined lateral shoulder area of the container. In this case, sufficient thinning is only possible by a very complex tool technology, accepting retracted areas, which renders cleaning very difficult. Moreover, the container cannot be completely emptied via these thin spots because they are not at the highest or lowest point of the container.

In contrast, U.S. Pat. No. 4,574,965 (Meierhoefer) discloses a container product produced by a blow molding, filling and sealing method having a specially designed double dome geometry without thinning for the container head, in this way ensuring a secure sealing and no particle formation when it is punctured using a cannula for an extraction from the container. In this case, thin wall thicknesses in the puncturing area are not necessary. The necessary double-dome geometry permits only one puncture point and deviates very much from the proven head geometry of blow, fill and seal infusion containers designed as container products and requires special cap systems, which do not comply with the well-proven ISO standard 15759:2006-05, which in turn is costly and can impair the functional safety of the entire container system.

Moreover, U.S. Pat. No. 4,574,965 (FIGS. 1 and 3) shows, as does CN 85103261 A (FIGS. 1, 2 and 3), a disadvantageous course of the mold parting line in the head area (FIGS. 1 and 3: seam 18). For that reason, the puncturing point is very close to the edge of the container head and carries the real danger of unintentionally puncturing the neck area of the container with the cannula even at an only slightly divergent piercing angle. Another disadvantage is the low central rigidity of the container head, addressed in DE 10 2013 012809. In this document numerous different dome head shapes having multiple top surfaces are proposed for the stiffening of the head area, which also require detailed adapted cap designs and significantly reduce the puncture area compared to the top surface in accordance with DIN EN ISO 15759:2006-05. This arrangement also reduces the possible spacing between the two puncture points, which in turn can result in disadvantages in the application, for instance in the administration of infusions, if the somewhat projecting drip chamber of a pierced infusion device (EN ISO 8536-4: 2013) blocks the puncture site for the cannula, which has to be used to inject another medication during the infusion.

FIG. 4 of EP 0621027 A1 (Weiler) discloses a container having a parting line (42, "parting line", column 8, II 26), which in an end-face view extends in a rectilinear line across the container body. Such a parting line typically results during blow molding due to the use of bi-partite molds. The parting line results from the separations of the bi-partite forming tool. The corresponding sealing or connecting seam in the head area has a minimal length and follows the course of the parting line in a rectilinear line. Just like in this example, sealed seams in general—not only in blow-molded containers—should be as short as possible to minimize the risk of weaknesses, imperfections or even leaks, which may have dire consequences for the health of the patient in the case of filled sterile containers for medical purposes.

In particular, sealing seams are sensitive and prone to occurring leaks in containers having a multilayer wall construction—for example as described in EP 1616549 B1 and DE 10347908 A1.

DE 10 2013 012 809 A1 relates to a container product, in which, instead of a uniform head membrane, which spans the end of the head part of the container body at a uniform curvature, different top surfaces are formed. The top surfaces form different curvatures at the head part end, such that for the possible total extraction surface of the head membrane, an increased resistance to deflection and easier puncturing, cutting or penetration is achieved. A deflection of the head membrane during extraction and the risk of leaks are kept to a minimum. The handling is safe even when using not very sharp piercing spikes, blades or thick cannulas.

SUMMARY OF THE INVENTION

Based on this prior art, the present invention addresses the problem of providing a container product that is further improved in comparison to the known solutions, in particular regarding the handling and extraction behavior of the contents of the container.

A container product solving this problem has a connecting seam seen on the free end face of the head membrane with a course of the seam at least partially deviating from a fictitious rectilinear course extending within the head membrane surface. The seam length is longer than a rectilinear course and at least partially extends around the penetrable areas allowing very thin-walled, penetrable areas to be formed. These penetrable areas are supported by the extended connecting or sealing seam, extending in the surface of the head membrane such that there is no unintentional denting of the entire head membrane resulting in impaired extraction behavior, in particular with regard to sterility during an extraction from or addition to the contents of the containers at the respective penetrable areas. As incorrect operations are precluded in this respect, the handling of the plastic container product according to the invention as a whole is made easier for an operator. Moreover, this container of the invention ensures a safe addition to and/or extraction of the contents of the container in each case. The support and bracing function for the addition or extraction procedure based on the connecting seam according to the invention is also ensured by the fact that, leaving the rectilinear alignment, it at least partially encompasses the penetrable areas, thus further stiffening the edges. The supporting and securing connecting seam of the head part permits the reduction of the penetrable areas on the free end face of the head membrane from the wall diameter compared to the other wall parts of the head membrane, which further facilitates the mentioned addition and/or extraction procedure.

Surprising to a person of ordinary skill in the art, compared to an otherwise rectilinearly oriented course, is that the substantially elongated connecting seam based on the known blow-molding, filling and sealing process (BFS) in a manner that is routinely safe in production, permits the manufacture of thinner areas as penetrable areas with thicknesses of 0.10 mm to 0.25 mm without any problems. Particularly, this container is without resulting leaks at the connecting seam, technically known as a head seal seam or head weld, and is without tearing occurring at the thin areas at internal pressure stresses in the temperature range above 110° C. Those temperature ranges occur, for instance, during the sterilization of the filled container product in the context of the required autoclave process. On one hand, owing to the counter-shearing movement of the still hot polymer in the third manufacturing step of the BFS process, i.e. during the sealing of the container head part, a favorable orientation of the polymer chains and/or an advantageous state of stress in the system head membrane/connecting seam/penetrable areas occurs. On the other hand, as already mentioned, the supporting effect of the connecting seam, which almost reaches the thin puncture areas, is of particular importance.

In a particularly preferred embodiment of the container product according to the invention, the course of the connecting seam is formed as a kind of sealing or welding seam, which is formed during the creation of the head part in the context of the blow molding, filling and sealing process (BFS). The seam extends on opposite sides of the head part along the head part and merges into the mold parting line that results from its production using multi-partite forming tools as part of the BFS process. In the production of the pertinent sealing seam for the head part, the penetrable areas mentioned are also formed in the head membrane in the context of the aforementioned production method. The thickness of the penetrable areas is reduced in comparison to the average wall thickness of the head membrane. In doing so, the sealing or welded seam fully penetrates the head membrane in a sealed manner.

It has further been found to be particularly advantageous, that the course of the seam in the head membrane merges at two opposite points into the corresponding parting lines/course of the seam in the other head part. Between them, the lines form a fictitious connecting rectilinear line, on which and/or outside of which the centers of the penetrable areas of the head membrane are located. In one embodiment the fictitious rectilinear line delimits at least one penetrable area in the manner of a tangent. Alternatively, this area is located at a predeterminable distance from the fictitious rectilinear line. In this way, the penetrable areas can be arranged in a supported manner on the head membrane of the container product for a variety of applications.

In this context, it has also been proven to be particularly advantageous to form the connecting seam similar to or exactly following the course of a sinusoidal wave on the head membrane. The wave trough and/or wave peak of each receives a penetrable area of the head membrane and comprises it at least partially in a supporting manner.

In a further particularly preferred embodiment of the container product according to the invention provision is made that the head part of the container body and/or a collar between the head part and the container body is preferably firmly connected to a cap part having externally detachable or detached puncture parts. The puncture parts are arranged congruently with the assignable penetrable areas of the head membrane. As the mentioned, penetrable areas in the head membrane can be arranged eccentrically, and the puncture parts of the cap part have to cover the penetrable areas for an extraction procedure. According to the invention, provision can be made advantageously to apply the cap parts to the container rotated by a predetermined offset angle.

Overall, a container product is created based on the solution according to the invention,

- which can be produced safely and reproducibly by the blow-molding, filling and sealing process with a low risk of leakage,
- whose container head geometry essentially corresponds to DIN ISO 15759:2006-05,
- which preferably has two spatially separated, equally penetrable areas having a controlled thinner wall thickness, during the puncturing of which using a standard cannula (DIN EN ISO 7864) very few particles—if any—are punched even without a cap, that permits low puncture forces when puncturing using a piercing device of an infusion device according to EN ISO 8536-4: 2013, and
- which permits the application of cap parts having two puncture sites on the container body even in oblique positions.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are schematic and not to scale.

DETAILED DESCRIPTION OF THE INVENTION

Figure 1:
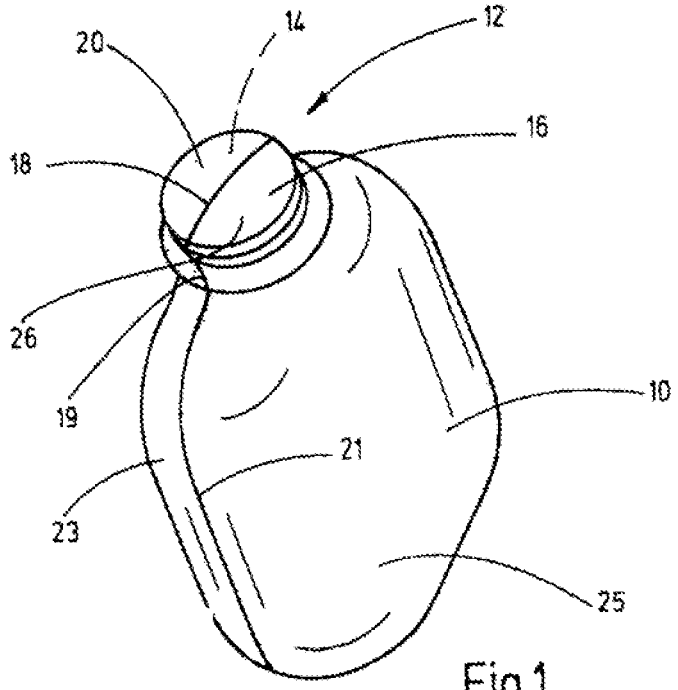
Fig.1 PRIOR ART
FIG. 1 is a perspective view, reduced in size in comparison with a built embodiment, of a plastic container product in the form of an infusion container having a head part according to the prior art according to DIN ISO 15759.

FIG. 1 shows a plastic container product disclosed in the prior art (DE 10 2013 012 809 A1), which is manufactured according to the blow molding, filling and sealing method (BFS), having a content of the container (not shown) of a conventional type. The container product comprises a container body 10 and an adjoining head part 12, which delimits an extraction area 14. The extraction areas 14 is closed by a head membrane 16, which has a connecting seam 18 extending through a plane spanned by the head membrane level 20 and separating two penetrable areas 22, 24 on the free end face 26 of the head membrane 16 for an extraction of the content of the containers as shown in detail in FIG. 2. The penetrable areas 22, 24 are illustrated in idealized form as a circle having the centers M1, M2, respectively. Further components of the head part 12 are a neck part 28 and a collar part 30.

The container product shown in FIG. 1 is an infusion bottle integrally manufactured according to the BFS method, of a plastic material, in particular a polyolefin material. The head part 12 formed in the example shown from the prior art in accordance with DIN ISO 15759:2006-05 can be connected to cap parts 31 in accordance with ISO 15759-BFS-A or ISO 15759-BFS-B by welding or injection molding onto the collar part 30, such as shown by way of example in FIGS. 9 and 10. The continuous and uniformly convex curved head membrane 16 is located at the free end-side end of the head part 12 for extraction and/or addition processes, which head membrane can be punctured for instance by a cannula (DIN EN ISO 7864) or piercing device 34 (EN ISO 8536) in the indicated arrow direction, such as in the FIG. 9 by way of example. Looked at from above in a vertical plan view of the end face 26 of the head membrane 16, the protruding curved seam 18 shown that follows a fictitious rectilinear course 32, which is shown in dashed lines in FIG. 2. This fictitious rectilinear course 32 establishes the shortest connection between two points E1 and E2, at which the known connecting seam 18 continuously merges into the adjoining shape-separating line 19 in the head part 12. The arcuate or chord-shaped connecting seam extending between the punctiform points E1 and E2 18 follows the curvature of the head membrane 16 and is formed as a reinforcing rib, preferably protrudes by a predetermined projection beyond the free end face 26 of the head membrane 16. Furthermore, the mold parting lines 19 merge into a mold parting line 21 of the container body 10, which in the BFS process is typically formed by a bi-partite mold.

Figure 2:
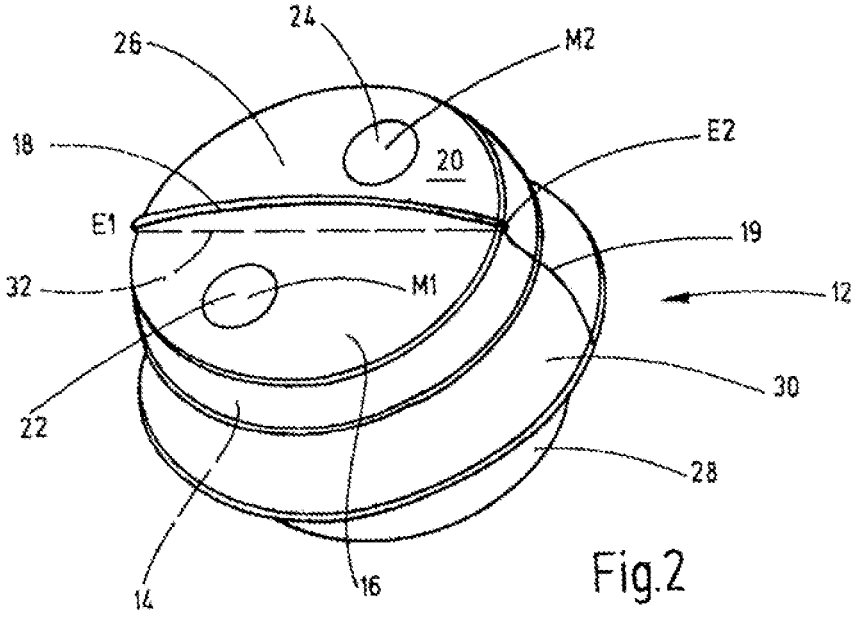
Fig.2 PRIOR ART
FIG. 2 is an enlarged perspective view of the head part of the container product as shown in FIG. 1.

Viewed in the direction of FIG. 2, the two opposite penetrable areas 22, 24 are located on both sides of the curved connecting seam 18, which for the sake of a better depiction are shown as closed circles having the centers M1 and M2. However, owing to their production, the areas 22, 24 can also have other peripheral geometries, for example elliptical, crescent-shaped or the like. These penetrable or pierceable areas 22, 24 have, as is suggested in FIG. 9, reduced wall thicknesses, which are thinner than the other wall thickness of the head membrane 16. The reduced wall thicknesses of the penetrable areas 22, 24, which, as explained above, may actually have a somewhat different shape than a circular shape, result from flow processes of the material during the manufacturing process by the BFS process. However, they can also be intentionally obtained by appropriate shaping using suitable tools in the head membrane 16. For the sake of completeness it should be mentioned that according to ISO 15759, the diameter of the head membrane 16 could typically be 30 mm.

Figure 9:
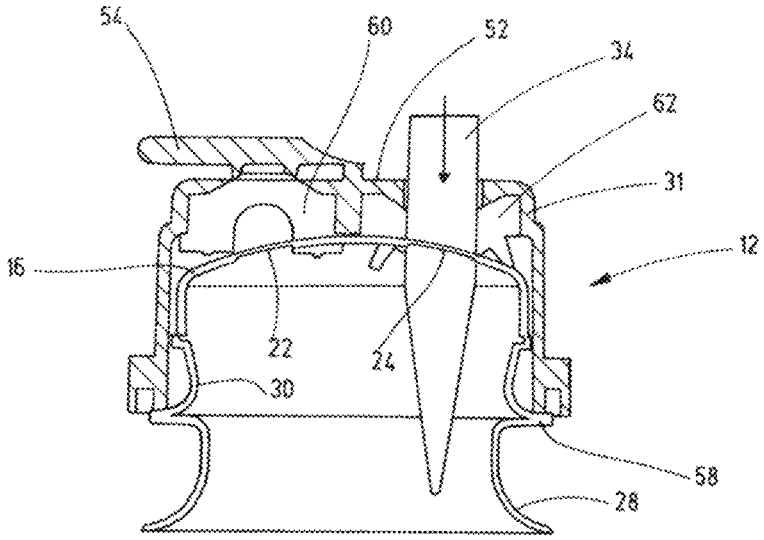
FIG. 9 is a side view in section through a head part of a container part according to a sixth exemplary embodiment of the invention, having a possible head membrane design according to one of FIGS. 3 to 8 and having an attached cap part, wherein the state during the piercing movement using a piercing device for performing an extraction procedure of the content of the containers is shown.

The connecting seam 18, which is also referred to as sealed head seam in technical terms, thus extends from the one point E1 of the head part 12 to the opposite point E2 of the same head part and, as reinforcing means in the form of a protruding rib, at least partially provides support against the unwanted indentation of the entire head membrane 16 when an extraction device, such as a cannula or a piercing device 34, is applied for a subsequent extraction or addition procedure in relation to the content of the containers. Without such a rib-shaped reinforcing means or reinforcement, puncturing the head membrane 16 would essentially not be possible when the piercing tool 34 is applied as shown in FIG. 9. Rather, for a thin-walled design, the head membrane 16 would be cambered inwards and prevent an effective piercing or penetration. If then, which appears to be obvious, the wall thickness of the head membrane 16 is designed having an appropriate thickness, such that the head membrane 16 itself forms a support even without a bead-like reinforced seam 18. However, an increased force is required for the piercing process by the piercing tool 34. In particular, the fragmentation mentioned above occurs, where the loose plastic particles from the thickened wall areas increasingly reach the extraction channel (not shown) of the piercing tool 34, which is to be avoided in any event.

Figure 3:
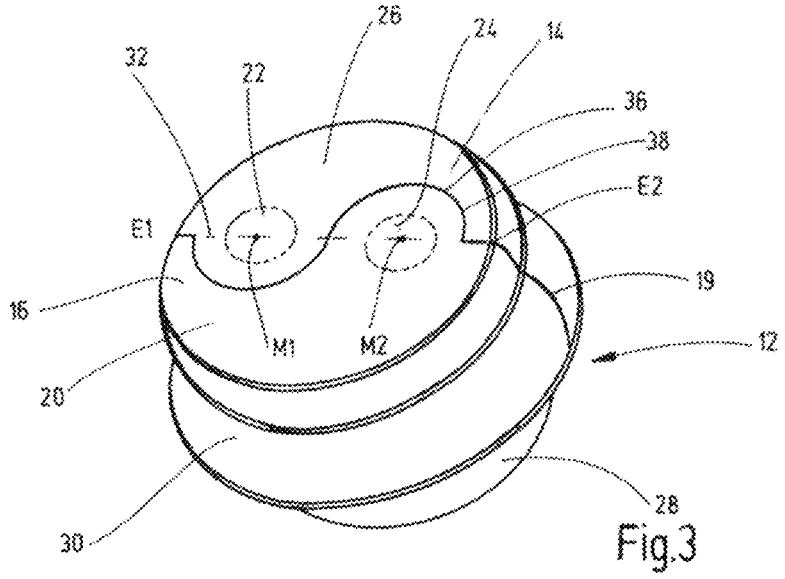
FIG. 3 is an enlarged perspective view of a head part for a container product according to a first exemplary embodiment of the invention.

Although the rib-shaped reinforcing seam 18 according to the representations in the prior art according to FIGS. 1 and 2 already provides a remedy for this problem; still, it has been found in practice that this known solution for a functionally reliable and undisturbed extraction procedure for a container, in particular in the form of an infusion container, still leaves something to be desired. An improvement can be fulfilled by the solution according to the invention as shown in FIG. 3 et seq. For completeness sake, for the extraction of the content of the container from the container by a piercing tool, an addition procedure of at least one medium may be provided upstream thereof, for example in the form of a drug delivery into the pre-filled container holding the container liquid, such as an infusion fluid. The piercing tool 34, which is only shown in principle in FIG. 9, can be a conventional injection needle of a syringe.

Figure 4:
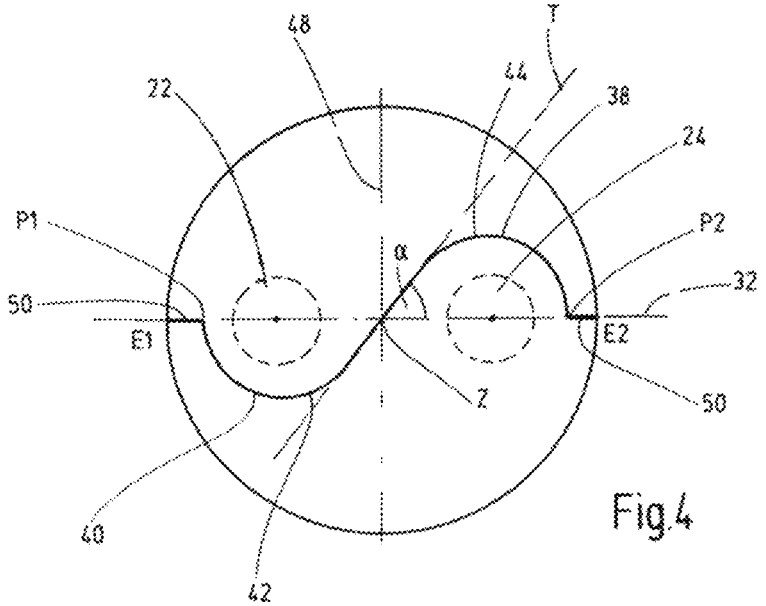
FIG. 4 is a frontal plan view of a head membrane, as used for a head part of FIG. 3.
Figure 6:
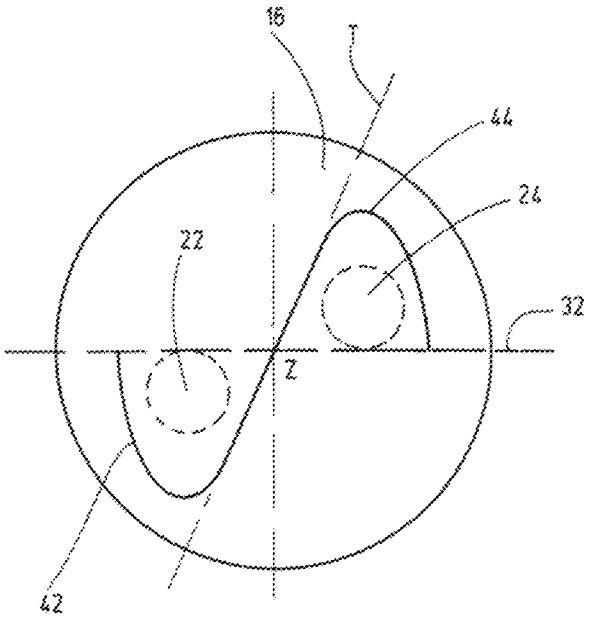
FIGS. 5 to 8 are frontal plan views of head membranes, with each having different courses of connecting seams and other arrangements of penetrable areas according to a second, third, fourth and fifth exemplary embodiments, respectively, of the invention.

In the solution according to the invention as shown in FIGS. 3 and 4, the connecting seam 38 arranged on the free end face 26 of the head membrane 16 has a seam course 36 deviating from the fictitious rectilinear course 32, which extends as a surface within the plane 20 or within the bulging head membrane 16. The seam course 36 is longer than the rectilinear course 32 and at least partially encompasses the penetrable areas 22, 24. The non-rectilinear course 36 of the connecting seam 38 according to the invention indicates the position or location of the respective penetrable areas 22, 24 at the head membrane 16 to an operator, as the connecting seam 38 comprises approximately half of the respective penetrable areas 22, 24.

As can also be seen from FIGS. 3 and 4, the connecting seam 38 extending within the plane 20 of the head membrane 16 has an alternating, preferably curved course that forms a sinusoidal wave 40. The wave trough 42 and the associated wave peak 44 of each receive one penetrable area 22 or 24 of the head membrane 16, and thus, at least partially comprises half of one. The seam course 36 in the head membrane 16 here also again merges at two opposite points E1, E2 into the other seam course in the head part 12. The two opposite points E1 and E2 between them form the fictitious connecting line 32, which corresponds to the fictitious rectilinear seam 32 as shown in FIG. 2. The centers M1, M2 of the penetrable areas 22, 24 of the head membrane 16 are located on this imaginary rectilinear connecting line 32.

The head membrane 16 has a circular outer circumference. The fictitious connecting line 32 defines a fictitious center point Z based on a further fictitious connecting line 48, which is perpendicular to the rectilinear line 32, through which the wave 40 as shown in FIG. 4 of the seam 38 according to the invention passes at the point of transition from wave valley 42 to wave peak 44.

If, as shown in FIG. 4, a tangent through the center point Z is applied to the wave trough 42 and the wave peak 44, this tangent T forms an angle $\alpha$ of approximately 50° with the imaginary connecting rectilinear line 32. Other angular dimensions a in the range of approx. 40° (FIG. 8) to 75° (FIG. 5) are possible depending on the embodiment of the connecting seam 38. In the embodiment shown in FIG. 7, the transition from wave trough 42 to wave peak 44 extends outside of the central fictitious center point Z through the consequently other center point Z+1, through which the tangent would then have to be centered, as shown in FIG. 4. The angle $\alpha$, however, remains unchanged.

As is further apparent from FIGS. 3 and 4, the start P1 of the wave trough 42 and the start or end P2 of the wave peak 44 of a wave 40 of the connecting seam 38 in each case transition into a section 50, which in turn viewed in plan view, towards the end face 26 of the head membrane 16, extends along the fictitious connection line 32. The respective sections 50 at the edge open into the opposite positions E1, E2 on the head part 12. Instead of rectilinearly selected sections 50, these can also have an arcuate course in continuation of the sine wave 40 or in the opposite direction to this wave path. The length of the wave-shaped connecting seam 38 is preferably selected to be longer than the diameter of the circularly shaped head membrane 16 by at least 30%.

Figure 8:
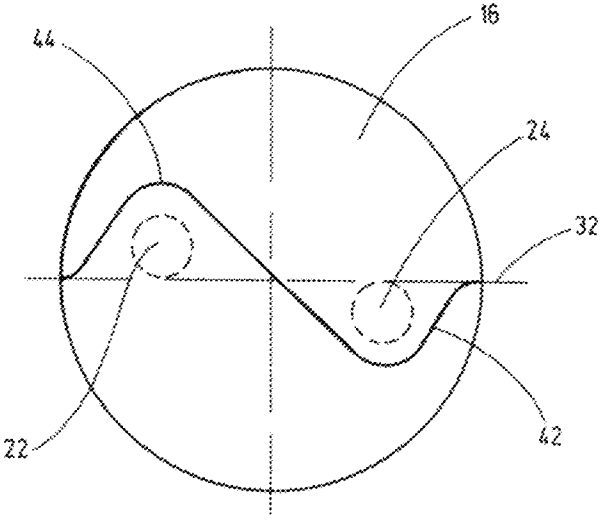

The penetrable or puncturable areas 22, 24 on the head membrane 16 are selected to be largely equal in size in the exemplary embodiment shown in FIGS. 3 and 4. As is further shown in FIG. 9, the two penetrable areas 22, 24 on the head membrane 16 have wall thicknesses, which are thinner than the other average wall thickness of the remaining head membrane 16. The average wall thickness of a penetrable areas 22, 24 is preferably between 0.15 mm and 0.35 mm. The wall thicknesses for each penetrable area 22, 24 can also be chosen differently, such that, for example, a penetrable area is particularly suitable for introducing a piercing cannula and another penetrable area permits good accessibility for the introduction of a syringe needle. Furthermore, the two surfaces of the penetrable areas 22, 24 can be selected to be of different sizes, as shown by way of example in FIG. 7 for a head membrane 16 changed in that respect. In one embodiment of a head membrane 16 as shown in FIG. 8 the sequence from wave trough 42 to wave peak 44 is altered such that viewed in the direction of FIG. 8, on the left side the wave peak 44 occurs before the wave trough 42.

The connecting seam 38 on the individual head membrane 16 may protrude in the manner of a reinforcing rib at least partially outwardly towards the environment and/or in the direction of the interior of the container body 10. An outward protrusion for the known solution according to the FIG. 2 is shown there. For the sake of simplicity, the rib design was omitted in the illustration in FIG. 3 et seq. The head membrane 16 shown in the figures is shown in each case as a curved surface in the form of the plane 20, which projects convexly outwards towards the environment. However, it is quite possible to form the head membrane 16 as a plane, i.e. an uncurved, planar plane (not shown). A polyethylene, a cyclic olefin polymer, a polypropylene but also a cyclic olefin copolymer, a polypropylene copolymer or a polypropylene blend can be used routinely as a plastic material for the container body 10. Furthermore, the container wall of the container according to the invention may have a multilayer structure (not shown) of at least two materials.

In order to obtain the wave-shaped connecting seam 38, the molding tools in the case of a corresponding molding device have to be designed such that they have the required mold recesses and protrusions on their opposite end faces in order to obtain the wave form for the head part 12. Such a molding device for moving molding tools for generating pertinent head geometries in plastic containers having slide control is shown in DE 103 17 712 A1 by way of example. The waveform shown in the figures for the connecting seam 38 has proven to be particularly advantageous in terms of manufacturing. However, other waveforms can be selected, for example, in the manner of an S-shaped arc having different courses of the curve. Furthermore, meandering seam courses or zigzag seam courses can be implemented, if required. It is important to select the course of the seam of the connecting seam 38 such that the respective penetrable areas 22, 24 are at least partially enclosed in order to sufficiently stabilize them during piercing. The elongated course of the seam 36 results in an improved reinforcement of the otherwise soft plastic head membrane 16. More than two penetrable areas can be mounted on the head membrane 16 (not shown).

The further embodiments of the head membrane 16 for a container product according to the invention as shown in the images in FIGS. 5 to 8 are explained only insofar as they differ substantially from the preceding embodiments and if they have not been sufficiently explained above.

Figure 5:
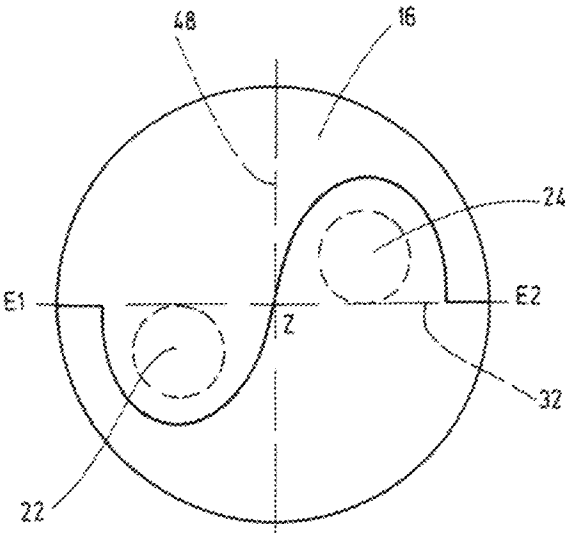

In the embodiment of a head membrane 16 shown in FIG. 5, the imaginary connecting rectilinear line 32 is tangent to the upper side of the penetrable area 22, and the further penetrable area 24 has a predeterminable axial distance to this connecting rectilinear line 32. In the embodiment shown in FIG. 6, the tangent T applied to wave trough 42 and wave peak 44, which passes through the center point Z, is steeper than that in the embodiment shown in FIG. 4. Furthermore, as a further tangent, viewed in the direction of FIG. 6, the connecting line 32 touches the top of the penetrable area 22 and the bottom of the further penetrable area 24, both of which are approximately the same size in terms of area.

Figure 7:
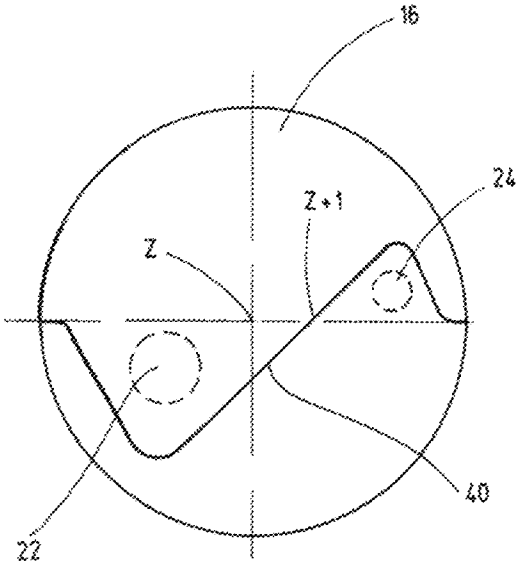

In the embodiment shown in FIG. 7, the penetrable area 24 is selected to be smaller in diameter than the penetrable area 22. Furthermore, as explained above, the course of the wave 40 through the further center point Z+1 is offset off center from the center point Z. In the embodiments shown in FIG. 8, the two penetrable areas 22, 24, which are approximately equal in size, are tangent to the connecting rectilinear line 32. As explained above, the course from wave trough 42 to wave peak 44 is reversed according to the exemplary embodiments shown in FIGS. 3 to 7.

Figure 10:
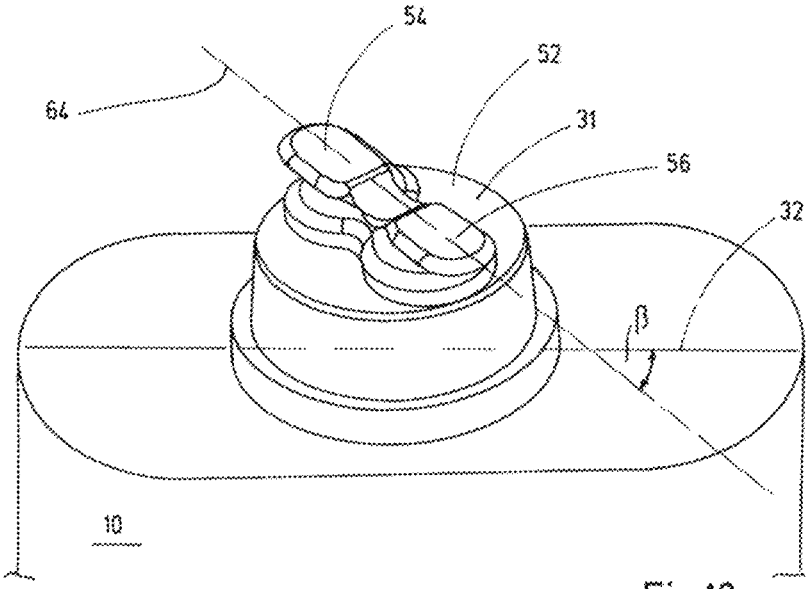
FIG. 10 is a perspective view of the cap part of FIG. 9 having puncture parts covered by the cap, wherein the position the cap part as a whole is arranged oblique in relation to the longitudinal direction of the container product only partially shown.

In the exemplary embodiment according to FIGS. 9 and 10, the cap part 31 is placed on the head part 12 in a manner known per se. The cap part 31 is preferably made of a rigid plastic material, which generally has the shape of a circular cup 52 having a bottom and detachable tabs 54, 56. As shown in FIG. 9, the right tab 56 is removed for an extraction procedure by the piercing tool 34. The lower edge of the cap part 31 is integrally attached to a flange part 58, which extends at the head part 12 between the collar part 30 and the neck part 28. For the sake of simplicity, FIG. 9 does not show the container body 10, which may also have a different shape than the container body 10 shown in FIG. 1 as shown in FIG. 10. The cap part 31 has two puncture parts 60, 62, which cover the respective penetrable areas 22, 24 in an assigned manner (see FIG. 9). The puncture parts 60, 62 each form a type of sealing part and are preferably formed of an elastomeric material having a low rigidity and low hardness. Preferably, thermoplastic elastomers are used for the puncture parts 60, 62, which can be joined to the cap part 31 in a simple manner by a substance-to-substance bond, for instance by welding. The cap part contacts the connecting seams 38, as shown in FIG. 9, by a cap center projection.

As is apparent from the illustration of FIG. 10, the transition in the form of the neck part 28 between the other head part 12 and the top of the container of the container body 10 has been omitted for the sake of simplicity. Furthermore, the solution having a cap part 31 according to FIGS. 9 and 10 provides a particularly safe solution, as the penetrable areas 22 and 24 are only detached for an extraction or addition procedure after the removal of the respective tabs 54 and/or 56, in which case the piercing tool 34 has yet to penetrate the respective elastomeric puncture parts 60, 62.

Furthermore, the solution according to the invention, as shown in particular in FIG. 10, can be used to set the cap part 31 on the head part 12 assigned to the penetrable areas 22, 24 in an offset. In this way, the two penetrable areas 22 and 24 can be on (FIG. 4) or outside (FIGS. 5-8) of the fictitious connecting rectilinear connecting line 32, such that in this respect the longitudinal axis 64 drawn through the two tabs 54, 56 forms an offset angle β with the fictitious rectilinear line 32, which angle can in the exemplary embodiment of FIG. 10 form an angle of approximately 45°. That angle may also readily have values between 0° (FIG. 4) and approx. 30° (FIG. 5) and more. Thus, it is possible depending on the purpose, to orient the cap orientation of the cap part 31 for a BFS bottle and its two openings 60, 62 to be in parallel to the axis 32 of the container 10. Designs having other cap orientations, preferably between 0° to 50°, to the longer transverse axis or connecting line 32 of the container bottle 10 as shown in the image of FIG. 10, are possible.

While various embodiments have been chosen to illustrate the invention, it will be understood by those skilled in the art that various changes and modifications can be made therein without departing from the scope of the invention as defined in the claims.

The invention claimed is:

1. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane and being longer than the rectilinear course; and first and second penetrable areas being in the head membrane, being separated by the connecting seam and being at least partially encompassed by the connecting seam, the first and second penetrable areas being defined by separate closed geometric figures within the free end face and spaced from one another by areas of the free end face outside of the closed geometric figures, the first and second penetrable areas being more easily pierced than the areas of the free end face outside of the closed geometric figures.

2. A plastic container product according to claim 1 wherein the connecting seam extends from a first edge point to an opposite second edge of the head membrane and reinforces and at least partially supports against unwanted indentation of the head membrane.

3. A plastic container product according to claim 1 wherein the seam course of the connecting seam indicates positions of the penetrable areas on the head membrane.

4. A plastic container product according to claim 1 wherein the seam course extends along an alternating curved course.

5. A plastic container product according to claim 4 wherein the alternating curved course is a single sinusoidal wave having a wave trough and a wave peak each receiving one of the first and second penetrable areas therein.

6. A plastic container product according to claim 1 wherein the connecting seam comprises a parting line formed during molding of the head part during the blow molding, filling and sealing method, the connecting seam extending between and to opposite sides of the head part and merging into a mold parting line of the container body resulting from molding tools.

7. A plastic container product according to claim 1 wherein the connecting seam extends between and merges into seams in the head part at opposite points of the connecting seam; and centers of the penetrable areas are on a straight line connecting the opposite end points.

8. A plastic container product according to claim 1 wherein the connecting seam extends between and merges into seams in the head part and opposite end points of the connecting seam; and centers of the penetrable areas are spaced from a straight line connecting the opposite end points and delimiting first and second parts of a surface area of the head membrane entirely containing the first and second penetrable areas, respectively.

9. A plastic container product according to claim 8 wherein the straight line is tangential to outer peripheries of the first and second penetrable areas.

10. A plastic container product according to claim 1 wherein the head membrane has a circular outer circumference;

the seam course has a wave form with a wave trough and a wave peak and with a center point between the wave trough and the wave peak; and the connecting seam extends to diametrically opposite end points on the circular outer circumference, the center point being at an intersection of a first straight line extending between the opposite end points and a second straight line extending perpendicular to the first straight line and being diametrical to the circular outer circumference.

11. A plastic container product according to claim 1 wherein the seam course has a wave form with a wave trough and a wave peak with a point therebetween, a tangent line through the point and applied to the wave through and the wave peak forming an angle of 10 to 90 degrees with a straight line extending between opposite point end points of the connecting seam.

12. A plastic container product according to claim 11 wherein the angle is 30 to 70 degrees.

13. A plastic container product according to claim 12 wherein the angle is 40 to 60 degrees.

14. A plastic container product according to claim 1 wherein the seam course has a wave form with a wave trough and wave peak and with straight sections between the wave form and opposite end points of an outer circumference of the head membrane.

15. A plastic container product according to claim 1 wherein the connecting seam has a seam length at least twenty percent longer than a length of a diameter of a circular outer circumference of the head membrane.

16. A plastic container product according to claim 15 wherein the seam length is at least thirty percent longer than the length of the diameter.

17. A plastic container product according to claim 1 wherein the first and second penetrable areas have a penetrable wall thickness thinner than an average wall thickness of the head membrane outside of the first and second penetrable areas.

18. A plastic container product according to claim 17 wherein the penetrable wall thickness is between 0.10 mm to 0.40 mm.

19. A plastic container product according to claim 17 wherein the penetrable wall thickness is between 0.15 mm to 0.35 mm.

20. A plastic container product according to claim 17 wherein the penetrable wall thickness of the first and second penetrable areas are different.

21. A plastic container product according to claim 1 wherein the first and second penetrable areas have different surface areas.

22. A plastic container product according to claim 1 wherein the connecting seams protrudes outwardly toward an environment in a direction away from the container body or inwardly in a direction toward the container body.

23. A plastic container product according to claim 1 wherein a cap part is connected to the head part and has externally detachable first and second tabs overlapping the first and second penetrable areas, respectively.

24. A plastic container product according to claim 23 wherein the cap part comprises piercing parts position on a line offset at an angle of less than seventy degrees relative to a straight line extending between end points of the connecting seam on an outer circumference of the head membrane.

25. A plastic container product according to claim 24 wherein the angle is less than fifty degrees.

26. A plastic container product according to claim 25 wherein the angle is less than thirty degrees.

27. A plastic container product according to claim 23 wherein the cap part contacts to the connecting seam, the connecting seam being on a free end face of the head membrane.

28. A plastic container product according to claim 1 wherein the head membrane is convexly curved.

29. A plastic container product according to claim 1 wherein the container product is formed of polyethylene, polypropylene, a polypropylene copolymer or a polypropylene blend.

30. A plastic container product according to claim 1 wherein the connecting seam curves around opposite sides of a line extending through centers of the first and second penetrable areas.

31. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane, being longer than the rectilinear course and extending along an alternating course; and first and second penetrable areas being in the head membrane, being separated by the connecting seam and being at least partially encompassed by the connecting seam, the alternating curved course being a single sinusoidal wave having a wave trough and a wave peak each receiving one of the first and second penetrable areas therein.

32. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane and being longer than the rectilinear course, the connecting seam extending between and merging into seams in the head part at opposite points of the connecting seam; and first and second penetrable areas being in the head membrane, being separated by the connecting seam and being at least partially encompassed by the connecting seam, centers of the penetrable areas being on a straight line connecting the opposite end points.

33. A plastic container product producible by a blow molding, filling and sealing method, the container product comprising:

a container body containing contents;

a head part adjoining the container body;

an extraction area delimited by the head part;

a head membrane closing the extraction area of the head part and having a free end face, the head membrane having a circular outer circumference;

a connecting seam on the head membrane extending through a surface spanning the head membrane, the connecting seam having a seam course at least partially deviating from a rectilinear course, extending on the head membrane and being longer than the rectilinear course, the seam course having a wave form with a wave trough and a wave peak and with a center point between the wave trough and the wave peak, the connecting seam extending to diametrically opposite end points on the circular outer circumference, the center point being at an intersection of a first straight line extending between the opposite end points and a second straight line extending perpendicular to the first straight line and being diametrical to the circular outer circumference; and first and second penetrable areas being in the head membrane, being separated by the connecting seam and being at least partially encompassed by the connecting seam.

34. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane and being longer than the rectilinear course, the seam course having a wave form with a wave trough and a wave peak with a point therebetween, a tangent line through the point and applied to the wave through and the wave peak forming an angle of 10 to 90 degrees with a straight line extending between opposite point end points of the connecting seam; and first and second penetrable areas being in the head membrane, being separated by the connecting seam and being at least partially encompassed by the connecting seam.

35. A plastic container product according to claim 34 wherein the angle is 30 to 70 degrees.

36. A plastic container product according to claim 35 wherein the angle is 40 to 60 degrees.

37. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane and being longer than the rectilinear course, the seam course having a wave form with a wave trough and wave peak and with straight sections between the wave form and opposite end points of an outer circumference of the head membrane; and first and second penetrable areas being in the head membrane, being separated by the connecting seam and being at least partially encompassed by the connecting seam.

38. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane and being longer than the rectilinear course;

first and second penetrable areas being in the head membrane, being separated by the connecting seam and being at least partially encompassed by the connecting seam; and a cap part being connected to the head part and having externally detachable first and second tabs overlapping the first and second penetrable areas, respectively, the cap part including piercing parts position on a line offset at an angle of less than seventy degrees relative to a straight line extending between end points of the connecting seam on an outer circumference of the head membrane.

39. A plastic container product according to claim 38 wherein the angle is less than fifty degrees.

40. A plastic container product according to claim 39 wherein the angle is less than thirty degrees.

41. A plastic container product producible by a blow molding, filling and sealing method, the container product comprising:

a container body containing contents;

a head part adjoining the container body;

an extraction area delimited by the head part;

a head membrane closing the extraction area of the head part and having a free end face;

a connecting seam on the head membrane extending through a surface spanning the head membrane, the connecting seam having a seam course at least partially deviating from a rectilinear course, extending on the head membrane and being longer than the rectilinear course; and first and second penetrable areas being in the head membrane, being separated by the connecting seam and being at least partially encompassed by the connecting seam, the first and second penetrable areas having a penetrable wall thickness thinner than an average wall thickness of the head membrane outside of the first and second penetrable areas.

* * * * *